US007537236B2

(12) United States Patent
Baumgartner et al.

(10) Patent No.: US 7,537,236 B2
(45) **Date of Patent: *May 26, 2009**

(54) SLIDING BOARD, ESPECIALLY A SKI, AND METHOD FOR PRODUCING THE SAME

(75) Inventors: Manfred Baumgartner, Lichtenwoerth (AT); Helmut Brandt, Leopoldsdorf (AT); Alois Himmetsberger, Vienna (AT); Marc Humann, Breitenbrunn (AT); Gernot Jahnel, Eichenbuechel (AT); Robert Pfaller, Vienna (AT); Raimund Premauer, Oggau (AT); Markus Schleinzer, Reifnitz (AT); Herwig Schretter, Vienna (AT); Karl Stritzl, Vienna (AT); Edgar Poellmann, Vienna (AT)

(73) Assignee: Tyrolia Technology GmbH, Schwechat (AT)

( * ) Notice: Subject to any disclaimer, the term of this patent is extended or adjusted under 35 U.S.C. 154(b) by 259 days.

This patent is subject to a terminal disclaimer.

(21) Appl. No.: 10/529,132

(22) PCT Filed: Sep. 15, 2003

(86) PCT No.: PCT/EP03/10248

§ 371 (c)(1), (2), (4) Date: Mar. 23, 2005

(87) PCT Pub. No.: WO2004/035152

PCT Pub. Date: Apr. 29, 2004

(65) Prior Publication Data

US 2005/0248127 A1 Nov. 10, 2005

(30) Foreign Application Priority Data

Sep. 24, 2002 (AT) ..... GM632/2002
Jul. 7, 2003 (AT) ..... A 1031/2003

(51) Int. Cl.
*A63C 5/00* (2006.01)

(52) U.S. Cl. ..... 280/607; 280/601; 280/609; 280/610

(58) Field of Classification Search ..... 180/607, 180/608, 609, 610, 14.22; 280/601–610
See application file for complete search history.

(56) References Cited

U.S. PATENT DOCUMENTS 3,722,901 A * 3/1973 Koike ..... 280/610

(Continued)

FOREIGN PATENT DOCUMENTS

AT OE 336460 5/1977

(Continued)

OTHER PUBLICATIONS

International Search Report dated Apr. 21, 2004 (2 pages).
Austrian Search Report dated Jul. 1, 2004 (1 page).
Austrian Office Action dated Oct. 30, 2003 (2 pages).

*Primary Examiner*—Christopher P Ellis
*Assistant Examiner*—Katy Meyer
(74) *Attorney, Agent, or Firm*—Flynn, Thiel, Boutell & Tanis, P.C.

(57) ABSTRACT

The invention relates to a sliding board, especially a ski, comprising a treadsole, an upper surface, a lower rib and a core, and at least one element which comprises especially at least one rail-type guiding element, is connected to the body of the sliding board by means of at least one anchoring element, and is used to arrange and guide at least one binding element on the upper side of the sliding board. In order to avoid subsequently fixing guiding elements to the finished ski, the at least one anchoring element (9, 9', 9", 19) is integrated into the core (5, 5") during the expansion thereof and is held by the hardened foam material.

14 Claims, 5 Drawing Sheets

U.S. PATENT DOCUMENTS

| | | | | | |
|---|---|---|---|---|---|
| 3,797,844 | A | * | 3/1974 | Smolka et al. | 280/617 |
| 3,814,452 | A | * | 6/1974 | Arnsteiner | 280/610 |
| 3,915,465 | A | * | 10/1975 | Matsuda | 280/607 |
| 3,915,466 | A | | 10/1975 | Matsuda | |
| 4,022,491 | A | | 5/1977 | Powell | |
| 5,016,901 | A | * | 5/1991 | Mayr | 280/607 |
| 5,197,752 | A | * | 3/1993 | Engelbert et al. | 280/610 |
| 5,207,445 | A | * | 5/1993 | Hoelzl | 280/607 |
| 5,221,105 | A | * | 6/1993 | Mayr et al. | 280/633 |
| 5,297,812 | A | * | 3/1994 | Dogat et al. | 280/633 |
| 5,498,016 | A | * | 3/1996 | Jodelet | 280/602 |
| 5,553,884 | A | * | 9/1996 | Abondance | 280/609 |
| 5,769,445 | A | * | 6/1998 | Morrow | 280/610 |
| 5,836,604 | A | * | 11/1998 | Piegay | 280/607 |
| 5,863,050 | A | * | 1/1999 | Meader et al. | 280/14.21 |
| 5,944,335 | A | * | 8/1999 | Riepler | 280/602 |
| 6,102,428 | A | * | 8/2000 | Bobrowicz | 280/607 |
| 6,183,000 | B1 | * | 2/2001 | Piatti | 280/610 |
| 6,557,866 | B2 | * | 5/2003 | Jones et al. | 280/14.22 |
| 6,641,162 | B2 | | 11/2003 | Allmann et al. | |
| 7,011,331 | B2 | * | 3/2006 | Riepler | 280/601 |
| 2003/0102651 | A1 | | 6/2003 | Riepler | |

FOREIGN PATENT DOCUMENTS

| | | |
|---|---|---|
| CA | 1052406 | 4/1979 |
| CH | 575768 | 5/1976 |
| DE | 1921589 | 11/1970 |
| DE | 2338232 | 2/1974 |
| DE | 3808780 | 10/1989 |
| DE | 3822900 | 1/1990 |
| DE | 29917078 | 3/2001 |
| EP | 1161972 | 12/2001 |
| EP | 1380323 | 1/2004 |
| FR | 2704155 | 10/1994 |
| WO | WO 01/45810 | 6/2001 |

* cited by examiner

SLIDING BOARD, ESPECIALLY A SKI, AND METHOD FOR PRODUCING THE SAME

FIELD OF THE INVENTION

The invention relates to a sliding board, especially a ski, with a running sole, an upper shell, a lower web and a core and also with at least one element for arranging and if appropriate for guiding at least one binding element on the upper side of the sliding board, which element is connected to the sliding board body by means of at least one anchoring element and comprises in particular at least one rail-type guide element.

The invention also relates to a method for producing a sliding board, especially a ski, in which a sliding board upper part preformed as a shell and comprising an upper shell is connected to a sliding board lower part comprising a running sole, lower web and if appropriate steel edges, and the core is formed by filling the interspace with foamed material.

BACKGROUND OF THE INVENTION

A sliding board with a profiled rail system is known from EP-A-1 161 972. The profiled rail system consists of at least one rail extending in the longitudinal direction of the sliding board, which is connected to the sliding board body by a dowel connection or anchoring via at least one formed-on dowel or dowel portion. The profiled rails are fastened to the sliding board when it is already finished and consequently only replace the otherwise usual screw fastening. In order to provide a sliding board with a premounted profiled rail system, it is therefore still necessary to carry out subsequent fastening and mounting operations.

SUMMARY OF THE INVENTION

The object of the invention is to provide a sliding board which does not have this disadvantage.

According to the invention, the object set is achieved by virtue of the fact that the anchoring element(s) is (are) integrated into the core when it is foamed and is (are) retained by the hardened foam.

In accordance with the method according to the invention, an element comprising in particular at least one guide element and intended for arranging and if appropriate for guiding a binding element is, by means of at least one anchoring element, passed through at least one opening and positioned in the preformed upper web, sliding board upper part and lower part are joined together, and filling with foamed material is then carried out, so that the anchoring element(s) is (are) connected to the core when the foam hardens.

According to the invention, the element(s) intended for the arrangement of binding parts or elements is (are) therefore already integrated into the structure of the sliding board, especially of the ski, when it is being produced. The otherwise usual subsequent fastening operations for arranging such elements or profiles are thus dispensed with, which simplifies production and handling and reduces production costs.

According to a preferred embodiment of the invention, the anchoring elements are made in such a way that they can be inserted through preformed openings in the upper shell, so that the openings surround the anchoring elements without a gap.

It is important that the anchoring elements are integrated firmly in the sliding board body in order that the profile can without further action withstand the loads which occur during functioning. In this connection, it is advantageous if the anchoring elements are provided with indentations, grooves, cutouts, openings and the like. The foam is consequently connected to the anchoring elements on a larger active surface.

The profile, or the guide element(s), can have a large number of preferably pin-shaped or bolt-shaped or similar anchoring elements.

Elongate elements extending in the longitudinal direction of the profile are also suitable as anchoring elements.

As soon as the anchoring elements are positioned on the upper web, the surface for adhesion to the foam can be enlarged, and consequently the retaining force of the anchoring elements can be improved, by parts which can be placed, pushed or screwed onto the elements and around which the foam of the core accordingly flows.

According to another embodiment of the invention, the surface for adhesion to the foam can be enlarged by one or more plate-shaped connecting elements, which interconnect two or more anchoring elements.

In order to prevent the liquid foamed material leaking onto the visible outer side of the sliding board in the region of the positioned anchoring elements during sliding board production, a sealing compound can be applied in the region of the gap between the shank of the anchoring element(s) and the respective opening from the underside after positioning of the anchoring element(s).

As an alternative to this, the anchoring elements can in each case be provided, in their region resting on the upper shell, with a cutting edge running around the opening in the upper shell, which edge is pressed into the upper shell either during positioning of the anchoring element or during pressing of the sliding board.

In a preferred embodiment, the sealing compound consists of an elastomeric material and is therefore, for example, a silicone sealing compound; according to another embodiment of the invention, the sealing compound can be an adhesive. Such sealing compounds are easy to handle and have a good sealing effect. Moreover, the use of such sealing compounds is associated with the advantage that the anchoring elements positioned on the sliding board parts are fixed at the same time, which simplifies handling during production of the sliding board.

BRIEF DESCRIPTION OF THE DRAWINGS

Further features, advantages and details of the invention are now explained in greater detail with reference to the drawing, which shows a number of illustrative embodiments and in which.

DETAILED DESCRIPTION OF THE INVENTION

Figure 1:
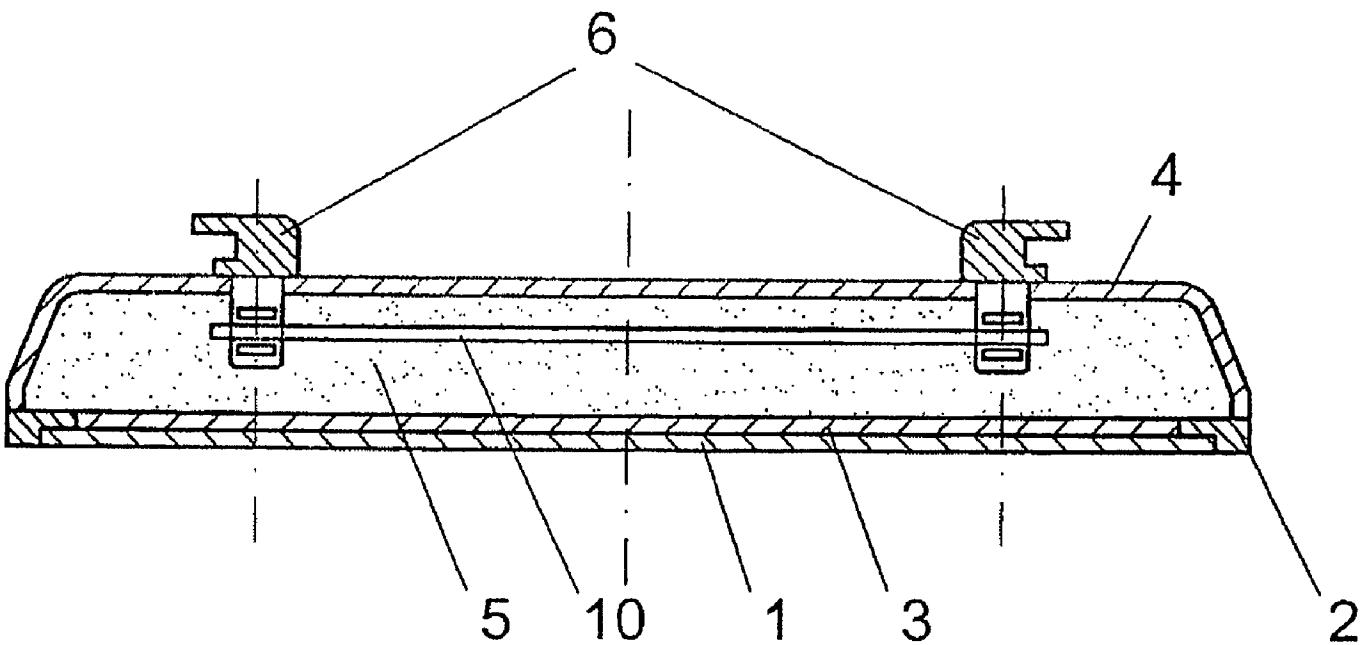
FIG. 1 shows an embodiment of a ski made according to the invention in cross section.

FIG. 1 shows a cross section through an embodiment of a ski, which has a running sole 1, steel edges 2, a lower web 3 and an upper shell 4. The core 5 of the ski is foamed, guide elements 6, which are made in the form of profiled rails onto which functional elements of a ski binding, for example a front or rear binding jaw or a baseplate of the same, are pushed and on which the functional elements are guided, being integrated during the foaming operation and retained by the hardened foam. In the embodiment shown in FIG. 1, a pair of rail-type guide elements 6 is integrated into the ski structure. The binding elements pushed onto the guide elements 6 can be arranged slidably movably or be connected to the guide elements 6 by means of a catching device. In the case of a slidably movable arrangement, the fixing and positioning in relation to the ski is carried out elsewhere.

The steel edges 2, the running sole 1, the lower web 3 and the upper shell 4 can be parts made in a known way. For example, the upper shell 4, which is illustrated as a single layer in FIG. 1, can also be made with two or more layers. The upper shell 4 is preferably made as a component which is preformed in a shell shape and is integrated during the foaming operation.

Figure 2B:
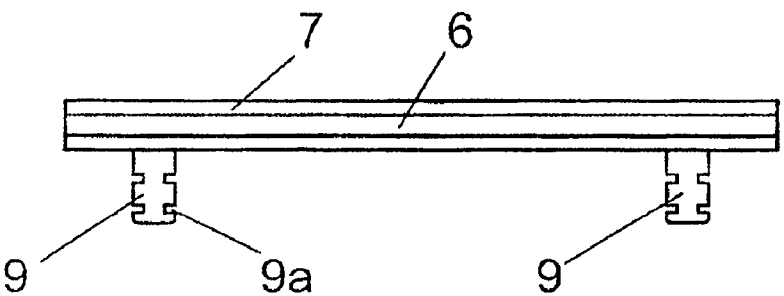
FIGS. 2*a* and 2*b* show a front view and a side view of the embodiment of guide elements shown in FIG. 1.
Figure 2A:
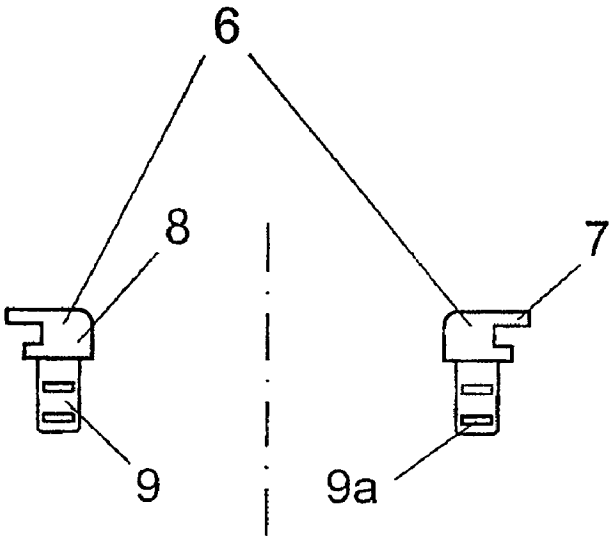

FIGS. 2*a* and 2*b* show views of the rail-type guide elements 6 from FIG. 1. The guide elements 6 are steel or plastic profiles, which are provided with offset profiled parts 7, onto which a ski binding part can be pushed and on which it can be slidably movably guided and which prevent the ski binding part from being lifted off from the ski. Each profiled part 7 is arranged on a base part 8, which extends over the entire length of the guide element 6 and is provided on its underside with at least two anchoring elements 9, which are preferably made in one piece with the guide elements 6 and produced together with these. In the embodiment shown in FIGS. 2*a* and 2*b*, the anchoring elements 9 are cylindrically shaped and consequently have approximately the shape of bolts or pins. Any other round or angular embodiments are possible for the anchoring elements 9, for example cuboid shape and the like.

The anchoring elements 9 are configured in such a way on the outside that they can be integrated well during the foaming operation for producing the core 5 in order to ensure that the anchoring elements 9 are located firmly and permanently in the core 5 of the ski. In the embodiment shown in FIGS. 2*a* and 2*b*, the anchoring elements 9 are provided with a number of indentations or grooves 9*a*. Embodiments with thread-type structures are also possible. Provision can also be made for separate elements, such as pins, platelets and the like, to be attached to the anchoring elements 9 in order to enlarge the surfaces gripped and surrounded by the foam. These elements can pushed on, screwed on and the like before the core is foamed.

For the insertion of the guide elements 6, the upper shell 4 is provided with corresponding cutouts or holes, which are to be made with as accurate a fit as possible. The anchoring elements 9 should therefore have their maximum diameter or cross section where they are surrounded by the upper shell 4 when the guide elements 6 have been positioned. Parts or elements projecting away from the anchoring elements 9 are therefore attached after the guide elements 6 have been positioned on the upper shell 4.

Figure 2C:
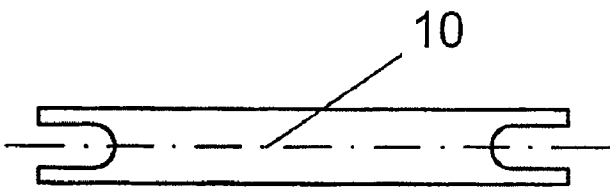
FIG. 2*c* shows a connecting element in a top view.

In order to improve the anchoring of the guide elements 6, they can be interconnected via connecting elements 10. A possible embodiment of a plate-shaped connecting element 10 is shown in FIG. 2*c*. Receiving locations, which allow the connecting element 10 concerned to be pushed onto two anchoring elements 9, are formed, by a fork-type design in each case, in the end portions of the connecting elements 10.

Figure 3B:
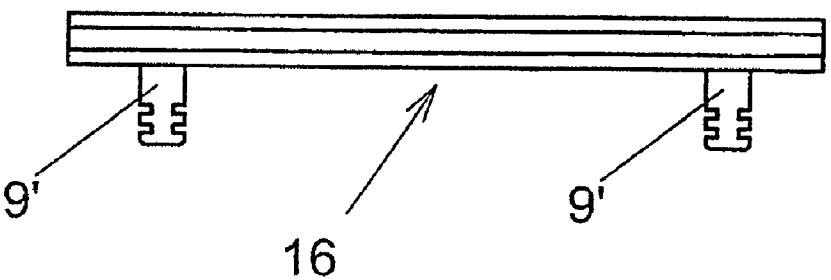
FIGS. 3*a* and 3*b* show a front view and a side view of an embodiment of a profile with guide elements.
Figure 3A:
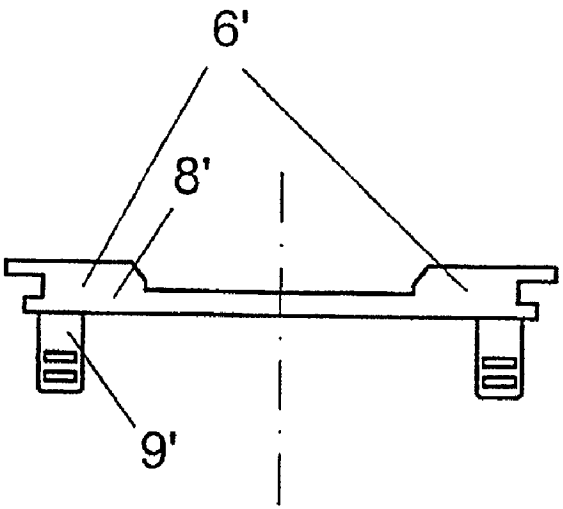

In the embodiment shown in FIGS. 3*a* and 3*b*, the two guide elements 6' are components of a profile 16 made in one piece, in which the two base parts 8' are interconnected centrally. In a similar way to FIGS. 2*a* and 2*b*, anchoring elements 9' are arranged on the underside of the base parts 8'. In this variant embodiment, two rows of anchoring elements 9' are preferably provided, in each case approximately in the region below the base parts 8'.

Figure 4:
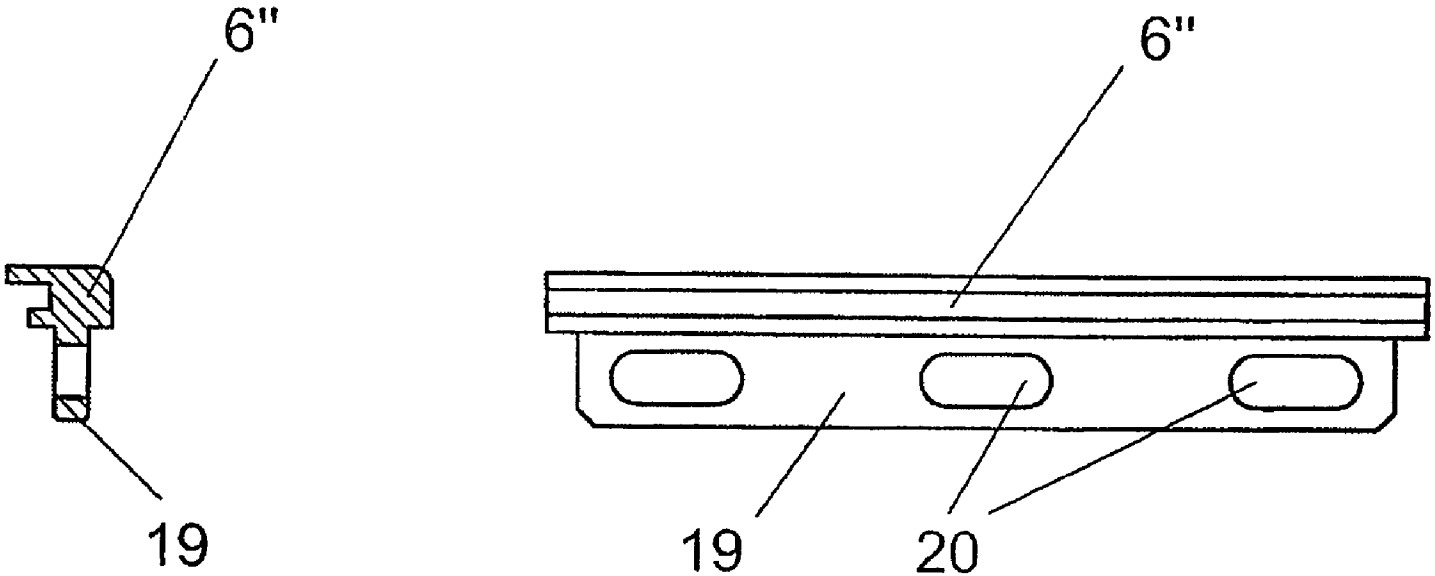
FIG. 4 shows another embodiment of a guide element in cross section and in a side view.

In the embodiment shown in FIG. 4, one guide element 6" of a pair of guide elements is shown, in the case of which at least one anchoring element 19 extending over a major portion of the longitudinal extent of the guide element 6" is provided instead of separate, in particular pin-type or bolt-type anchoring elements. In this connection, more than one anchoring element 19 can be provided on a single guide element 6". The anchoring element(s) 19 allow(s) positioning of the guide elements 6" in the upper shell 4 through correspondingly designed slots during production of the ski. As FIG. 4 shows, the anchoring element 19 can be provided with a number of holes 20, through which the foam introduced for forming the core can flow. Instead of such holes 20 or openings, which can have any shape, depressions, grooves and the like can also be provided. After positioning on the upper shell, additional elements improving the anchoring in the material of the core can also be pushed on, clipped on and the like on the anchoring elements 19.

Figure 5:
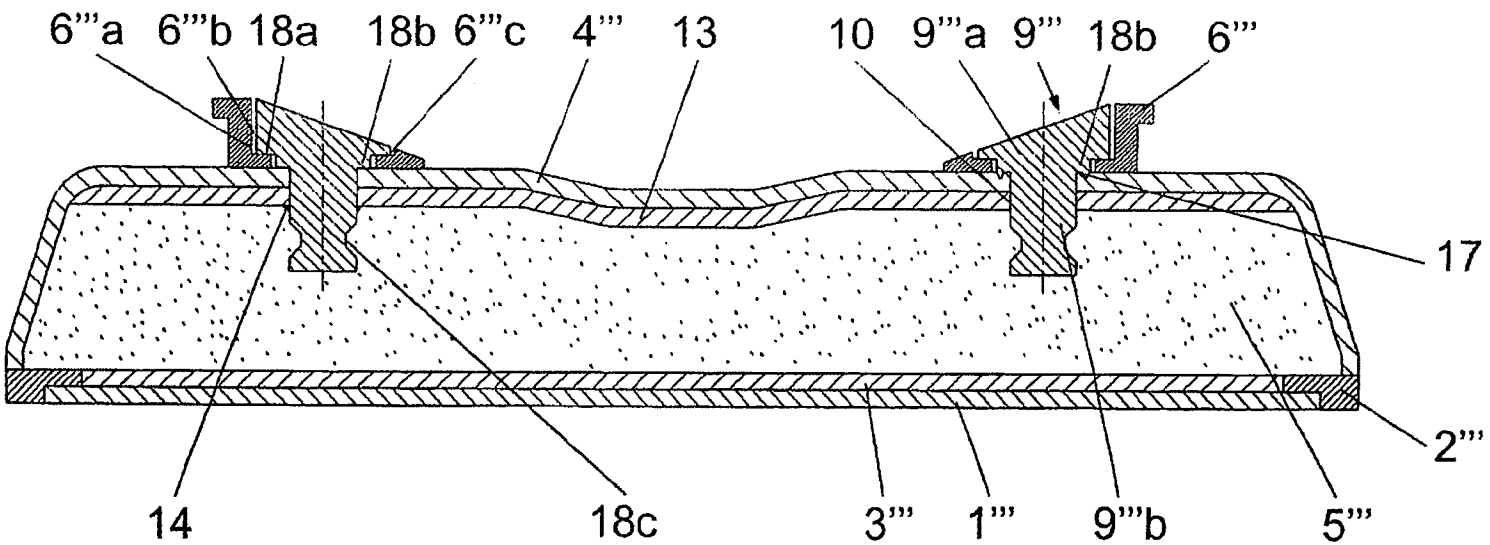
FIG. 5 shows a cross section through a ski with further variant embodiments of the invention.

FIG. 5 shows a cross section through an embodiment of an alpine ski, which comprises an upper shell 4''' forming the upper side of the ski and the two longitudinal sides of the ski, a running sole 1''', edges 2''' made of steel and a foamed core 5'''. A lower web 3''' adjoins the running sole 1''' on the inside as a further layer, and an upper web 13 adjoins the upper shell 4''', on the inside as a further layer. The upper web 13 and the lower web 3''' are layers which reinforce the ski structure. The upper shell 4''' itself can be constructed from one or more layers and is provided with a design or with design elements. The upper shell 4''', the upper web 13, the running sole 1''', the lower web 3''' and the steel edges 1''' are in particular preformed and prefabricated parts; the core 5''' is produced by filling the ski with foamed material after it has been assembled and introduced into a mold.

The anchoring elements 9''' of an interface element, which have been positioned during ski production, have been integrated firmly into the foamed material of the core 5''' during the hardening of the foamed material. In the embodiment illustrated, the interface element is a guide element 6''' with a rail-type profile, which, together with a second guide element 6''' arranged symmetrically in relation to the longitudinal axis of the ski in the same way, is intended for arranging, fastening and/or guiding ski binding parts, for example a toe-piece or a heel-holder of a safety ski binding. In particular a pair of guide elements 6''' with a rail-type profile, which extend on the upper side of the ski, is therefore connected to the ski via the anchoring elements 9'''. The guide element 6''' has in its region facing the lateral surface of the ski a guide strip 6'''*a* extending in the longitudinal direction of the ski, so that, with arrangement of the guide elements 6''' in pairs, baseplates or supporting plates of ski binding parts can be pushed on. The guide element 6''' is provided with receiving bores 6'''*b* for inserting the anchoring elements 9'''. Each anchoring element 9''' has a head 9'''*a*, which, with the underside of a first inwardly offset region 18*a*, bears against a surrounding support surface 6'''*c* of the guide element 6''', and, with the underside of a second inwardly offset region 18*b*, bears against the upper side of the upper shell 4'''.

The in particular essentially cylindrical shank 9'''*b* of the anchoring element 9''' has been pushed through holes or openings 10 adapted to it in the upper shell 4''' and the upper web 13 and is provided with a circumferential groove 18*c*, so that the hardened foamed material retains the anchoring element 9''' firmly in the interior of the sliding board. The retention of the anchoring elements 9''' in the interior of the sliding board can be improved further by other measures which are not the subject of this invention.

During the production of the ski from its individual components, the upper shell 4''' and the upper web 13 are provided with the openings or holes 10 for the anchoring elements 9'''. After the guide elements 6''', together with the anchoring elements 9''', have been positioned on the upper shell 4''' and the upper web 13, the gap between the shank 9'''*b* of the positioned anchoring elements 9''' and the upper web 13 can be sealed all the way round with a sealing compound 14 from the inside, as shown in the case of the anchoring element 9''' illustrated on the left in FIG. 5. The sealing compound 14 can be an adhesive, a silicone compound or the like. The sealing compound 14 therefore prevents liquid foamed material passing or leaking through into the region of the upper side of the ski during the pressing operation during ski production and moreover retains the anchoring elements 9''' in their position.

In the case of the anchoring element 9''' illustrated on the right, another variant for sealing the outer side of the upper shell 4''' in relation to the foamed material 16, which has been introduced but is still liquid, is shown. Here, in the region 18*b* of the head 9'''*a* of the anchoring element 9''', an all-round cross-sectionally approximately triangular cutting edge 17 is provided, facing in the direction of the upper shell 4'''. When the anchoring elements 9''' are positioned during ski production, the cutting edge 17 penetrates the material of the upper shell 4''' and in this way forms an all-round barrier, so that foamed material which is still liquid and may pass through between the shank 9'''*b* of the anchoring element 9''' and the upper shell 4''' is prevented from passing further outward. The two sealing possibilities shown in FIG. 5 can be used at the same time.

In the embodiment of the invention illustrated in FIG. 5, the anchoring elements can also be made in one piece with the interface elements.

Instead of the rail-type guide elements 6''' illustrated, one-piece rails, plates or the like with any positioning and fixing devices for ski binding parts can be provided.

The illustrative embodiments described and represented relate to use of the invention in a ski. However, the invention can also be implemented in other sliding boards, for instance snowboards.

The invention claimed is:

1. A method for producing a sliding board, in which a sliding board upper part preformed as a shell and comprising an upper shell is connected to a sliding board lower part comprising a running sole, lower web and steel edges, and a core is formed by filling an interspace with foamed material, comprising the steps of attaching an element comprising at least one guide element for arranging and guiding a binding element by passing at least one anchoring element through at least one opening in the preformed upper shell, covering a gap between a shank of the anchoring element and the opening from the underside by a sealing compound when the anchoring element has been positioned, joining together the sliding board upper part and lower part, and foaming the core so that the anchoring element is connected to the core when the foam hardens.

2. The method as claimed in claim 1, wherein the sealing compound consists of an elastomeric material.

3. The method as claimed in claim 2, wherein said elastomeric material is a silicone sealing compound.

4. The method as claimed in claim 1, wherein the sealing compound is an adhesive.

5. A method for producing a sliding board, in which a sliding board upper part preformed as a shell and comprising an upper shell is connected to a sliding board lower part comprising a running sole, lower web and steel edges, and a core is formed by filling an interspace with foamed material, comprising the steps of attaching an element comprising at least one guide element for arranging and guiding a binding element by passing at least one anchoring element through at least one opening in the preformed upper shell, joining together the sliding board upper part and lower part, and foaming the core so that the anchoring element is connected to the core when the foam hardens, and providing said at least one anchoring element in a region resting on the upper shell, with a cutting edge running around the opening, and pressing said edge into the upper shell either during positioning of the anchoring element or during joining of the sliding board upper part and lower part.

6. A sliding board which is produced in accordance with claim 5.

7. A sliding board, with a running sole, an upper shell, a lower web and a hardened foam core and rail-type guiding elements extending in the longitudinal direction of the sliding board and for arranging at least one binding element on an upper side of the sliding board, said rail-type guiding elements each being connected to the sliding board body by at least two anchoring elements being in one piece with the respective rail-type guiding element, an anchoring element of a first of the rail-type guiding elements being connected to an anchoring element of a second of the rail-type guiding elements by a connecting element, wherein said anchoring elements and said connecting element are integrated into said core when it is foamed, in direct contact with the foam and retained by the hardened foam.

8. The sliding board as claimed in claim 7, wherein said anchoring elements are inserted through preformed openings in said upper shell.

9. The sliding board as claimed in claim 8, wherein said preformed openings in the upper shell surround respective anchoring elements without a gap.

10. The sliding board as claimed in claim 7, wherein said anchoring elements are provided with one of indentations, grooves, cutouts, and openings.

11. The sliding board as claimed in claim 7, wherein said anchoring elements are one of pin-shaped, bolt-shaped, and elongate and are in one piece with the arranging element comprising a rail-type guide element.

12. The sliding board as claimed in claim 7, wherein said anchoring elements bear parts which are placed, pushed and/or screwed thereto and which enlarge a surface area thereof for adhesion to the core material.

13. The sliding board as claimed in claim 7, wherein said connecting element is plate-shaped.

14. A sliding board, with a running sole, an upper shell, a lower web and a hardened foam core and with rail-type guiding elements extending in the longitudinal direction of the sliding board and for arranging at least one binding element on an upper side of the sliding board, said rail-type guiding elements each being connected to the sliding board body by anchoring elements inserted into the respective rail-type guiding element and bearing against the rail-type guiding element, an anchoring element of a first of the rail-type guiding elements being connected to an anchoring element of a second of the rail-type anchoring elements by a connecting element, wherein the anchoring elements and the connecting element are integrated into said core when it is foamed, in direct contact with the foam, and are retained by the hardened foam.

* * * * *